United States Patent [19]

Kusz

[11] Patent Number: 4,759,456

[45] Date of Patent: Jul. 26, 1988

[54] TAMPER-INDICATING PACKAGE AND PLASTIC CLOSURE THEREFORE

[75] Inventor: Maximillian Kusz, Waterville, Ohio

[73] Assignee: Owens-Illinois Closure Inc., Toledo, Ohio

[21] Appl. No.: 925,574

[22] Filed: Oct. 31, 1986

[51] Int. Cl.[4] ..... B65D 41/34

[52] U.S. Cl. ..... 215/252

[58] Field of Search ..... 215/252, 253

[56] References Cited

U.S. PATENT DOCUMENTS 4,401,227 8/1983 Pehr ..... 215/252

4,572,388 2/1986 Luker et al. ..... 215/252

*Primary Examiner*—George E. Lowrance

*Assistant Examiner*—Nova Stucker

*Attorney, Agent, or Firm*—H. G. Bruss

[57] ABSTRACT

A tamper-indicating package that includes a blown glass container or blow molded plastic container, and a molded thermoplastic closure that is affixed to the finish portion of such container. The finish portion of the container has a radially outwardly projecting bead at the bottom portion of such finish portion. The closure has a flexible tab that originally extends outwardly and downwardly from the top of a notch in the skirt of the closure, and is foldable through the notch in the skirt of the closure to engage the underside of the bead in the finish of the container. The closure tab is attached to the closure skirt by a frangible connection, and separates from the closure skirt by the fracture of such frangible portion during the removal of the closure from the container, since the tab is prevented by its engagement with the container bead from being removed with the other elements of the closure.

17 Claims, 4 Drawing Sheets

TAMPER-INDICATING PACKAGE AND PLASTIC CLOSURE THEREFORE

BACKGROUND OF THE INVENTION

1. Field of the Invention

This invention relates to a package of the tamper-indicating type, that is, to a package that includes a container and a closure affixed to such container, the closure being subject to structural alteration upon its first removal from the container to provide a visually detectable sign that the package has been opened. Packages of the aforesaid type are widely used in the packaging of comestible products such as food products, beverage products, and medications to provide an indication to the consumer, upon the first opening of the package, of possible prior tampering with the package or with its contents.

2. Description of the Prior Art

Various container/closure packages are known in the prior art which subject the closure to structural alteration upon the first removal of the closure from the associated container to provide a visual indication that the package has been subjected to a previous opening attempt, and to thereby alert a consumer to possible prior tampering with the package or its contents upon the first opening of the package by such consumer. For example, U.S. Pat. No. 4,550,844 (Lininger), which is assigned to the assignee of this application, discloses a tamper-indicating package that utilizes a molded plastic closure with a marginal tear-off band which is attached to a main skirt portion of the closure by several frangible bridges, and which is subject to disengagement from the main skirt portion of the closure by the fracturing of the frangible bridges, upon the first removal of the closure from the container. The disengagement of the tear-off band from the main skirt portion of the closure of the aforesaid U.S. Pat. No. 4,550,844 results from interference between a plurality of wedged-shaped tabs attached to the tear-off band which engage the underside of a bead on the outside of the container finish to prevent the removal of the tear-off band upon the unscrewing of the closure from the container finish. U.S. Pat. Nos. 4,506,795 (Herr), 4,478,343 (Ostrowsky), and 4,402,218 (Ostrowsky) disclose similar types of tamper-indicating container/closure packages.

Tamper-indicating container/closure packages which require the complete removal of a marginal band portion of the closure of any such package require close manufacturing tolerances with respect to the dimensions of the closure and container, they require fairly high application torques to force the tamper band over the container finish bead, torques which sometimes lead to broken bridges between the closure and the associated tamper-indicating band, and require high torques to remove the closure from the container, which can be a problem in the packaging of any type of comestible consumer product, and can be a particular problem in the packing of various type of medications, since many of the patients who take such medications are elderly and suffer from reduced hand grip strength or function or otherwise suffer from impaired hand function.

SUMMARY OF THE INVENTION

In accordance with the present invention there is provided a tamper-indicating container/closure package which utilizes a molded plastic closure that incorporates a removable tab as the tamper-indicating element.

The tab is molded on the outside of the closure and is attached thereto by one or more frangible bridges. The tab, which need only take up a small part of the circumference of the closure, overlies a notch in the skirt of the closure, and is folded under the adjacent portion of the skirt of the closure, through the notch, into its use position in a post-molding operation. The tamper-indicating tab of the closure, when in its use position, is normally in interference with a locking bead on the closure finish, or other projection on the closure finish, but it can be deflected outwardly by such locking bead or projection upon the application of the closure to the container, until the tip of the closure tamper-indicating tab clears the underside of the locking bead or projection, whereupon the tab returns inwardly to its original position and the dimensional interference between the container locking bead or projection and the tip of the closure tamper-indicating tab is reestablished. Thus, upon the unscrewing or other removal of the closure from the container, the interference between the container locking bead or projection and the closure tamper-indicating tab will prevent the tamper-indicating tab from being removed with the closure, thereby breaking the tamper-indicating tab away from the closure and establishing a visually detectable sign on the underside of the notch in the skirt of the closure of the prior removal or attempted removal of the closure from the container. Since the arcuate extent of the tamper-indicating tab of the closure of the tamper-indicating package of the present invention is small, and since the tamper-indicating tab can be provided with sufficient thickness and resiliency to engage the underside of a container locking bead or other projection without the need for close dimensional tolerances therebetween, both the container component and the closure component of the tamper-indicating package of the present invention can be manufactured using normal dimensional tolerances, the closure can be initially applied to the container without excessively high application torques, and can be removed from the container without excessively high removal torques.

Accordingly, it is an object of the present invention to provide an improved tamper-indicating container/closure package.

It is a further object of the present invention to provide a tamper-indicating container/closure package whose container and closure components can be mass produced without the need to adhere to exceptionally strict dimensional tolerances in the manufacture thereof.

It is also an object of the present invention to provide a tamper-indicating container/closure package in which the closure may be applied to the container without the need for excessively high application torques, and in which the closure can be removed from the container without the need for exceptionally high removal torques.

For further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
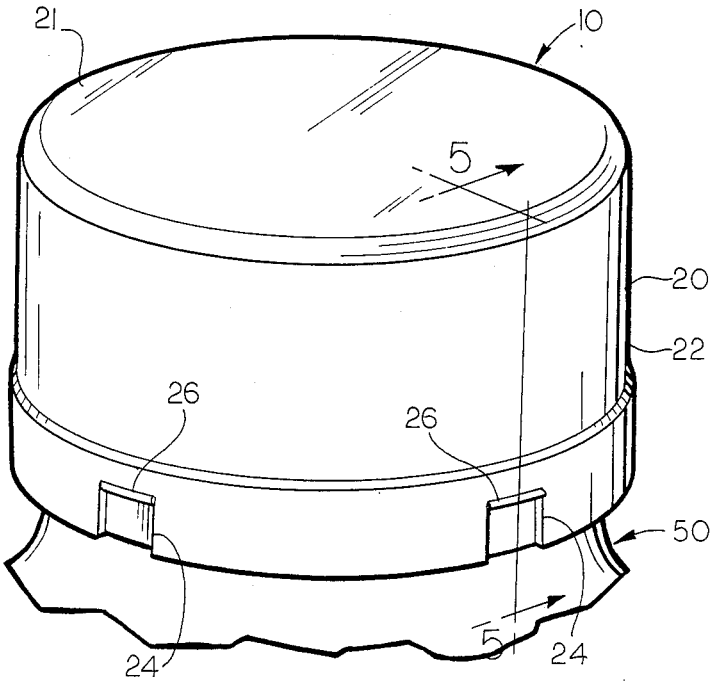
FIG. 1 is a fragmentary perspective view of the preferred embodiment of a package according to the present invention, the package including a container and a closure affixed thereto.

The tamper-indicating package according to the present invention is made up of a closure, indicated generally by reference numeral 10, and a container, shown fragmentarily, and indicated generally by reference numeral 50. As is shown fragmentarily in FIGS. 5 and 7, the closure 10 is made up of a closure body 20 and a liner 40. The closure body 20 is preferably molded in a single piece, as by injection molding or compression molding, from a suitable thermoplastic material, such as high density polyethylene or polypropylene. The liner 40 may be formed from pulp or a suitable plastic material, so long as it will form a suitable seal on the container 50, and will be compatible with the product to be packaged in the container 50. The container 50 may be considered to be either a blown glass container or a blow molded thermoplastic container, the selection of the material for the container 50 normally being based upon the susceptability of the contents of the container to attack by oxygen or other ingredients of air which may permeate through the wall of a plastic container, or to infra-red or ultra-violet radiation which may pass through the wall of the glass container, all is as well understood in the art.

The container 50 has a neck or "finish" portion 51 that defines an upper open mouth 53 of the container 50, the finish portion 51 terminating in a rim 52. The container 50 also has a body portion 54, and body portion 54 is separated from the finish portion 51 by means of a radially outwardly projecting locking bead 55. As is clear from FIGS. 5 and 7, the radial extent of the radially outwardly projecting locking bead 55 is greater than the radial extent of any other portion of the finish 51.

The container 50 is of the type which is adapted to be closed by a threaded closure, and to engage such a threaded closure, the finish 51 of the container 50 has a helical thread 56 projecting radially outwardly therefrom. The helical thread 56 is located between the rim 52 of the container 50 and the radially outwardly projecting locking bead 55.

The closure body 20, in general, is made up of a top panel 21 that spans the upper open mouth 53 of the container 50, and an annular skirt 22 that extends downwardly from the top panel 21 to surround the upper portion of the finish 51 of the container 50, including the helical thread 56. The closure 10 is normally held in place on the finish 51 of the container 50 by means of a helical thread 23 which projects radially inwardly from the annular skirt 22 to engage the helical thread 56 on the finish 51 of the container 50 to form a screw-on and screw-off fit between the closure 10 and the container 50.

Tamper-indicating opening characteristics are imparted to the package of the present invention by providing the annular skirt 22 of the closure body 20 with one or more three-sided slots 24 extending upwardly into the annular skirt 22 from the bottom edge thereof, with a tamper-indicating tab 25 being attached to the annular skirt 22, and, preferably, being integrally molded with the closure body 20, the tamper-indicating tab 25 being attached to the annular skirt 22 at the top side of each of the slots 24 by a thinned, frangible portion 26 of the annular skirt 22. As is shown in FIGS. 2, 3, 5 and 7 each tamper indicating tab 25 is generally Y-shaped, having a stem portion **25*a* which is attached to the annular skirt 22 of the closure body 20 at the frangible portion 26 thereof, with arm portions 25*b* and 25*c* extending in opposite directions from the end of the stem portion 25*a* that is away from the connection of the stem portion 25*a* to the frangible portion 26**.

Figure 2:
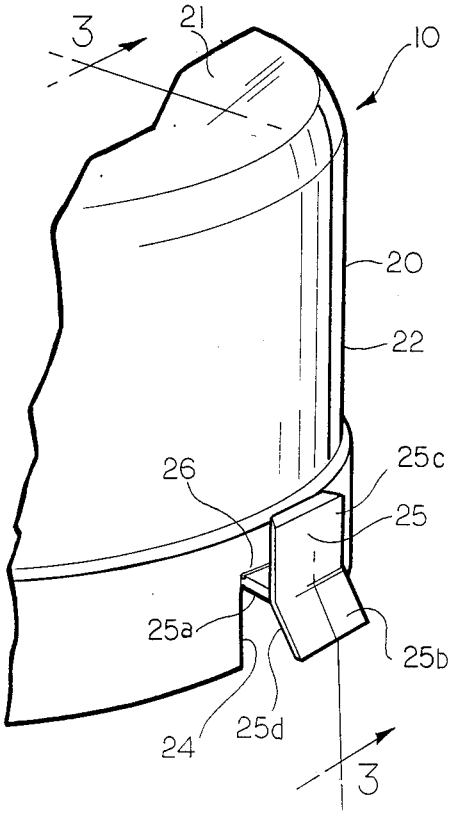
FIG. 2 is a fragmentary perspective view of the closure of the package illustrated in FIG. 1.
Figure 3:
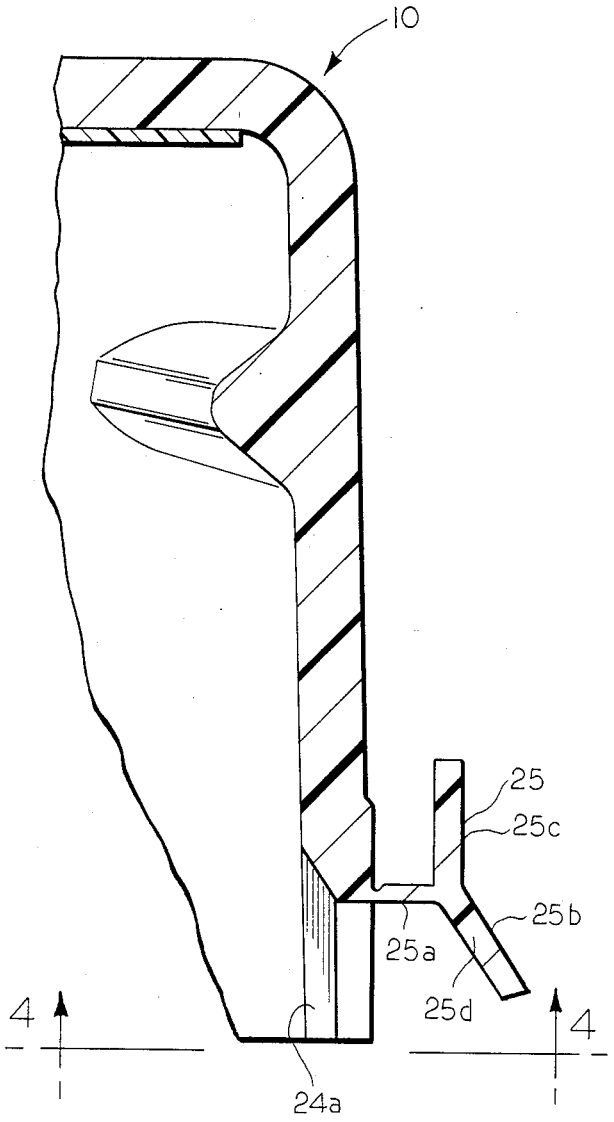
FIG. 3 is a sectional view taken on line 3—3 of FIG. 2.
Figure 5:
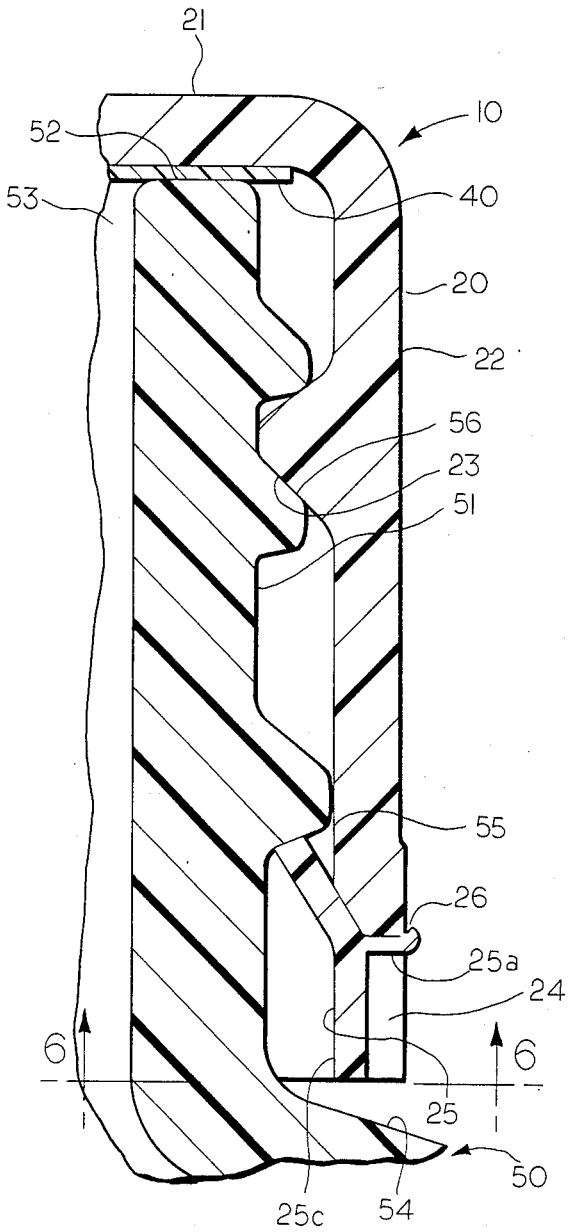
FIG. 5 is a sectional view taken on line 5—5 of FIG. 1.
Figure 7:
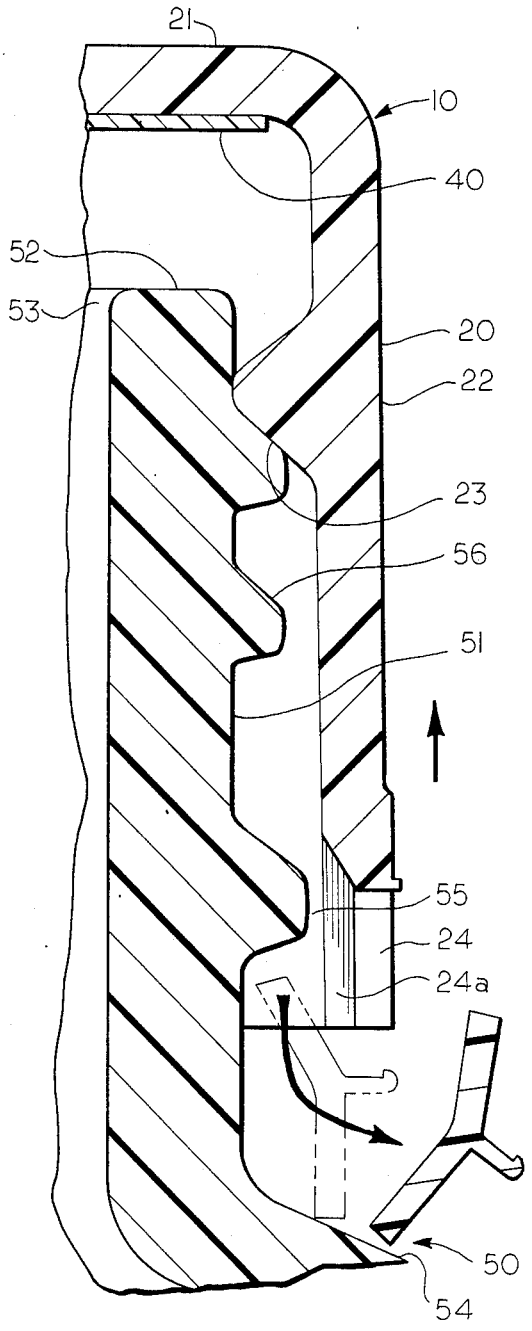
FIG. 7 is a view similar to FIG. 5 showing the package of the present invention with the closure component thereof partially removed from the container component thereof.

Before the closure 10 is applied to the container 50, the tamper-indicating tab 25 is rotated approximately 180°, for example, in a post-molding operation, from the orientation illustrated in FIG. 2 to the orientation shown in FIG. 5. Thus, when the closure 10 is initially applied to the container 50, the arm portion **25*b* of the tamper-indicating tab 25 will be resiliently deflected inwardly as it passes down over the helical thread 56 and the locking bead 55 until it clears the tip of the locking bead 55, whereupon the arm portion 25*b* of the tamper-indicating tab 25 will spring back to engage the underside of the locking bead 55 in an interference fit. Subsequently, upon the removal or the attempted removal of the closure 10 for the container 50, the interference fit between the arm portion 25*b* of the tamper indicating tab 25 and the underside of the locking bead 55 of the finish portion 51 of the container 50 will prevent the tamper-indicating tab 24 of the closure body 20 from being removed from the rest of the closure body 20, causing the frangible portion 26 of the closure body 20 to fracture and freeing the tamper-indicating tab 25 to fall away from the closure 10 and the container 50 as is shown in FIG. 7**.

Figure 4:
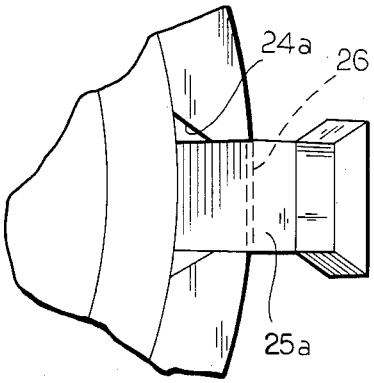
FIG. 4 is a sectional view taken on line 4—4 of FIG. 3.
Figure 6:
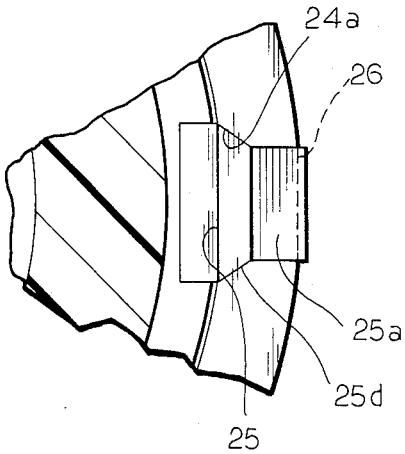
FIG. 6 is a sectional view taken on line 6—6 of FIG. 5.

As is shown in FIGS. 4 and 6, the tamper-indicating tab 25 has a width which is at least slightly greater than the width of the slot 24 form which its extends. Thus, upon the rotation of the tamper-indicating tab 25 through the slot 24, which may be accomplished due to the resiliency of the thermoplastic material used in the molding of the closure body 20, the tamper-indicating tab 25 will be prevented form springing back through the slot 24 to its original position. If desired, vertical ribs may be molded into the interior of the annular skirt 22 of the closure body 20 to provide sufficient rigidity to such annular skirt, to thereby prevent undue deflection of the portion of the annular skirt 22 that is near the tamper-indicating tab 25 during the application and removal of the closure 10 to the container 50. Further, as is shown in FIGS. 3, 4, 6 and 7, each slot 24 is, preferably, provided with a bevelled edge **24*a* which extends therearound and which is engaged by a bevelled edge portion 25*d* of the tamper-indicating tab 25 to permit the tamper-indicating tab 25 to be nested with the slot 24**.

Although the best mode contemplated by the inventor for carrying out the present invention as of the filing date hereof has been shown and described herein, it will be apparent to those skilled in the art that suitable modifications, variations, and equilvalents may be made without departing from the scope of the invention, such scope being limited solely by the terms of the following claims.

What is claimed is:

1. A tamper-indicating package comprising, in combination:

a container having a central axis and comprising an open mouth and finish surrounding said open mouth, said finish of said container comprising:

closure engaging means; and bead means projecting radially outwardly from said finish, said bead means being axially spaced further along said central axis from said open mouth of said finish than said closure engaging means; and a closure surrounding and removably engaging said finish and closing said open mouth of said container, said closure comprising:

a top panel spanning said open mouth of said container;

a skirt affixed to said top panel and extending therefrom generally parallel to said central axis of said container to surround said bead means of said finish, said skirt having a bottom edge that is away from said top panel;

container finish engaging means, said container finish engaging means of said closure being engageable with said closure engaging means of said container to permit said closure to be applied to and removed from said finish of said container; and a notch in said skirt of said closure, said notch extending into said skirt from said bottom edge to an edge of said notch; and a generally Y-shaped tab with a stem portion having a first end and a second end, said first end being frangably attached to said skirt of said closure at a location adjacent said edge of said notch, said tab further having first and second arm portions each of which is attached to said second end of said stem portion, said first and second arm portions extending away from said second end of said stem portion, one of said first and second arm portions having a free end which is adapted to come into interfering engagement with said bead means of said container after said closure is applied to said finish of said container, said interfering engagemnt with said bead means causing said tab to separate from said skirt of said closure at said location adjacent said edge of said notch by virtue of being frangibly attached to said skirt of said closure to provide an indication of the removal or attempted removal of said closure from said container.

2. A tamper-indicating package according to claim 1 wherein said closure engaging means of said container comprises helical thread means affixed to said finish of said container and projecting radially outwardly from said finish of said container, and wherein said container finish engaging means of said closure comprises helical thread means affixed to said skirt of said closure and projecting radially inwardly from said skirt of said closure, wherein said helical thread means affixed to said skirt of said closure is engageable with said helical thread means affixed to said finish of said container to permit said closure to be applied to and removed from said finish of said container by screwing and unscrewing.

3. A tamper-indicating package according to claim 1 wherein said top panel, said skirt, said container finishing engaging means and said tab means are integrally molded in a single piece from a thermoplastic material.

4. A tamper-indicating package according to claim 3 wherein the major ingredient of said thermoplastic material is selected from the group consisting of high density polyethylene and polypropylene.

5. A tamper-indicating package according to claim 2 wherein said top panel, said skirt, and said helical thread means affixed to said skirt of said closure are integrally molded in a single piece from a thermoplastic material.

6. A tamper-indicating package according to claim 1 wherein said one of said first and second arm portions has sufficient flexibility to permit said free end to be deflected outwardly of said bead means on said container.

7. A tamper-indicating package according to claim 1 wherein said bead means of said container comprises an annular bead.

8. A tamper-indicating package according to claim 1 wherein said notch has a bevelled edge portion and wherein at least a portion of said tab has a bevelled edge whereby said bevelled edge of said at least a portion of said tab can be nested within said bevelled edge portion of said notch.

9. A tamper-indicating package comprising, in combination:

a container having a central axis and comprising an open mouth and a finish surrounding said open mouth, said finish of said container comprising:

closure engaging means; and bead means projecting radially outwardly from said finish, said bead means being axially spaced further along said central axis from said open mouth of said finish than said closure engaging means; and a closure surrounding and removably engaging said finish and closing said open mouth of said container, said closure comprising:

a top panel spanning said open mouth of said container;

a skirt affixed to said top panel and extending therefrom generally parallel to said central axis of said container to surround said bead means of said finish, said skirt having a bottom edge that is away from said top panel;

container finish engaging means, said container finish engaging means of said closure being engageable with said closure engaging means of said container to permit said closure to be applied to and removed from said finish of said container;

a notch in said skirt of said closure, said notch having a width and extending into said skirt from said bottom edge to an edge of said notch; and tab means formed integrally with said skirt of said closure and being frangibly attached to said skirt of said closure at a location adjacent said edge of said bead means, said bead means causing said tab means to separate from said skirt of said closure at said location adjacent said edge of said notch by virtue of being frangably attached to said skirt of said closure to provide an indication of the removal or attempted removal of said closure from said container, said top panel, said skirt, and said container finish engaging means of said closure being integrally molded in a single piece from a thermoplastic material, said tab means having a portion with a width that is greater than said width of said notch, said portion having sufficient flexibility to be folded through said notch from a molding position into interfering engagement with said portion of said bead means of said container, said tab means further having sufficeint rigidity to be resistant to folding back through said notch into said molding position.

10. A closure having a central axis for use with a container having an open mouth, a finish with closure engaging means and annular bead means below the closure engaging means surrounding the open mouth, said closure being adapted to form a tamper-indicating package with said container and comprising:

a top panel extending across said central axis and being adapted to removably span the open mouth of the container, an annular skirt attached to and extending generally normally form said top panel, said annular skirt being adapted to surround the finish portion of the container, said skirt having a bottom edge that is away from said top panel;

container finish engaging means attached to said annular skirt and extending radially inwardly therefrom, said container finish engaging means being engageable with the closure engaging means of the container to permit said closure to be removably affixed to the container;

a notch in said skirt of said closure, said notch extending into said skirt from said bottom edge to an edge of said notch; and a generally Y-shaped tab with a stem portion having a first end and a second end, said first end being frangibly attached to said skirt of said closure, said tab further having first and second arm portions each of which is attached to said second end of said stem portion, said first and second arm portions extending away form said stem portion in opposite directions, one of said first and second arm portions having a free end which is adapted to come into interfering engagement with the annular bead means of the container, the interfering engagement with the annular bead means being adapted to cause said tab to separate from said skirt of said closure at said location adjacent said edge of said notch by being frangibly attached to said skirt of said closure to provide an indication of the removal or attempted removal of said closure from the container.

11. A closure according to claim 10 wherein the closure engaging means of the container comprises helical thread means affixed to the finish of the container and projecting radially outwardly from the finish of the container, and wherein said container finish engaging means of said closure comprises helical thread means, said helical thread means of said closure being engageable with the helical thread means of the container to permit said closure to be applied to and removed from said container by screwing and unscrewing,

12. A closure according to claim 10 wherein said top panel, said annular skirt, and container finish engaging means and said tab means are integrally molded in a single piece from a thermoplastic material.

13. A closure according to claim 12 wherein the major ingredient of said thermoplastic material is selected from the group consisting of high density polyethylene and polypropylene.

14. A closure according to claim 11 wherein said top panel, said skirt, and said helical thread means affixed to said skirt and said closure are integrally molded in a single piece from a thermoplastic material.

15. A closure according to claim 10 wherein said one of said first and second arm portions has sufficient flexibility to permit said free end to be deflected outwardly by the annular bead means on the container during application of said closure to the container.

16. A closure having a central axis for use with a container having an open mouth, a finish with closure engaging means and annular bead means below the closure engaging means surrounding the open mouth, said closure being adapted to form a tamper-indicating package with said container and comprising:

a top panel extending across said central axis and being adapted to removably span the mouth of the container;

an annular skirt attached to and extending generally normally from said top panel, said annular skirt being adapted to surround the finish portion of the container, said skirt having a bottom edge that is away from said top panel;

container finish engaging means attached to said annular skirt and extending radially inwardly therefrom, said container finish engaging means being engageable with the closure engaging means of the container to permit said closure to be removably affixed to the container;

a notch in said skirt of said closure, said notch having a width and extending into said skirt from said bottom edge to an edge of said notch; and tab means formed integrally with said skirt of said closure and being frangibly attached to said skirt of said closure at a location adjacent said edge of said notch, said tab means having a portion which is adapted to come into interfering engagement with the annular bead means of the container after said closure is applied to the finish of the container, the interfering engagement with the annular bead means being adapted to cause said tab means to separate from said skirt of said closure at said location adjacent said edge of said notch by virtue of being frangibly attached to said skirt of said closure to provide an indication of the removal or attempted removal of said closure from the container, said top panel, said skirt, and said container finish engaging means of said closure being integrally molded in a single piece from a thermoplastic material, said tab means having a portion with a width that is greater than said width of said notch, said portion having sufficient flexibility to be folded through said notch from a molding position in which said tab means is not adapted to come into interfering engagement with the annular bead means of the container into an application position in which said tab means is adapted to come into interfering engagement with the annular bead means of the container, said portion of said tab means of the container, said portion of said tab means further having sufficient rigidity to be resistant to folding back through said notch into said molding position.

17. A closure according to claim 16 wherein said notch has a bevelled edge portion and wherein at least a portion of said tab means has a bevelled edge whereby said bevelled edge of said at least a portion of said tab means can be nested within said bevelled edge portion of said notch.

* * * * *